US008141727B2

(12) United States Patent
Gruenwald et al.

(10) Patent No.: US 8,141,727 B2
(45) Date of Patent: Mar. 27, 2012

(54) WATER BOTTLE WITH DOSAGE IN A DISPENSER CAP

(75) Inventors: Eric William Gruenwald, Dallas, TX (US); Lawrence Lambelet, Flemington, NJ (US); Patrick James Mulligan, Dallas, TX (US)

(73) Assignee: Patrick Mulligan, Dallas, TX (US)

( * ) Notice: Subject to any disclaimer, the term of this patent is extended or adjusted under 35 U.S.C. 154(b) by 294 days.

(21) Appl. No.: 12/430,838

(22) Filed: Apr. 27, 2009

(65) Prior Publication Data

US 2010/0181279 A1 Jul. 22, 2010

Related U.S. Application Data

(60) Provisional application No. 61/145,528, filed on Jan. 17, 2009.

(51) Int. Cl.
*B65D 1/04* (2006.01)

(52) U.S. Cl. ..... 215/6; 215/228; 215/201; 221/265; 220/521

(58) Field of Classification Search ..... 215/6, 201, 215/228, 329, 250, 227, 253, 252; 220/522, 220/521, 554.1, 254.8, 252, 212, 254.3, 259.3; 221/266, 265, 208, 191, 100; 206/219, 220, 206/528, 539, 538, 217; 222/516, 144, 541.5, 222/541.6, 39

See application file for complete search history.

(56) References Cited

U.S. PATENT DOCUMENTS

| | | | | |
|---|---|---|---|---|
| 2,878,964 | A | 10/1953 | Avis | |
| 3,866,797 | A | 2/1975 | Palomo | |
| 4,778,070 | A * | 10/1988 | Walker | 215/232 |
| 4,828,143 | A | 5/1989 | Jennings | |
| 4,957,219 | A * | 9/1990 | Robbins et al. | 222/39 |
| 5,853,093 | A * | 12/1998 | Neiger | 215/237 |
| 6,112,942 | A | 9/2000 | Deacon | |
| 7,017,780 | B2 | 3/2006 | Renaud | |
| 7,055,709 | B1 * | 6/2006 | Esau | 215/228 |
| 2002/0139709 | A1 | 10/2002 | Bunyan | |
| 2003/0000910 | A1 * | 1/2003 | Jang et al. | 215/227 |
| 2003/0217987 | A1 * | 11/2003 | Pehr | 215/252 |
| 2005/0184024 | A1 | 8/2005 | Santa Cruz | |
| 2006/0266764 | A1 | 11/2006 | Bieger | |

* cited by examiner

*Primary Examiner* — Anthony Stashick
*Assistant Examiner* — Kevin Castillo
(74) *Attorney, Agent, or Firm* — Lawrence Lambelet

(57) ABSTRACT

A solid dosage preparation is provided with a bottle of water. The solid dosage preparation is housed in a compartment of a closure applied to the bottle of water. The solid dosage preparation is capable of being dispensed in a single-handed manipulation of a roller-like chamber. The roller-like chamber is provided with a means for indicating any tampering of the enclosed solid dosage preparation, which is maintained in a protective environment between the chamber and the compartment.

4 Claims, 4 Drawing Sheets

WATER BOTTLE WITH DOSAGE IN A DISPENSER CAP

CROSS-REFERENCE TO RELATED APPLICATIONS

Priority is claimed to Provisional Application 61/145,528, filed Jan. 17, 2009.

FIELD OF THE INVENTION

This invention relates to bottled water products, and more particularly to a nutritionally enhanced drink.

BACKGROUND OF THE INVENTION

Additives are commonly sold in combination with bottled water. Currently marketed examples include energy, or health, drinks, where the additive is provided in solution form. Other examples include a medication where the bottled water is supplied simply as a convenience for washing down a pill or a capsule.

In particular instances involving nutritional supplements, however, it is useful to supply the supplement in solid dosage form, similar to the medication example. Doing so improves the shelf stability of a natural active ingredient, and particularly one of a biological derivation, which might otherwise degrade or lose potency over time when in dissolution.

In contrast with the medication circumstance, however, the water is not just a convenience for administering the dosage. It is also a measured amount of ingredient required for the best metabolic results. Therefore, the means for combining the two components into a single package is an important aspect of the product put-up.

The bottle closure typically provides such means in the prior art. For example, in U.S. Patent Application 2003/0000910 to Jang, a cap to a water bottle contains a compartment for the dosage. The compartment is closed with a separate cap, which may be attached by a hinge. Such a device does not selectively dispense a dosage, however.

U.S. Pat. No. 3,866,797 to Palomo discloses a dispensing cap for a pill bottle, but two hands are required for manipulating it. Furthermore, the device would not be compatible with a screw-threaded neck finish, such as that typically found on stock water bottles. U.S. Pat. No. 6,112,942 to Deacon teaches a single-hand dispensing mode using a roller-type mechanism, but Deacon, as in the other references above, does not provide a safety feature for the prevention of tampering.

The prior art is missing a dispensing cap capable of single-handed operation which protects its solid dosage contents both from handling damage and from tampering.

SUMMARY OF THE INVENTION

In view of the above-mentioned unfulfilled needs, the present invention embodies, but is not limited by, the following objects and advantages:

A first objective of the present invention is to provide a solid dosage preparation together with a bottle of water.

A second objective of the present invention is to provide the solid dosage preparation in a dispenser package which selectively dispenses the preparation with one-handed convenience.

A third objective of the present invention is to utilize a stock, or commodity, bottle for the water.

A fourth objective of the present invention is to provide protection with respect to light degradation and handling damage for the solid dosage preparation.

A fifth objective of the present invention is to render both the water and the solid dosage preparation secure from tampering.

In a preferred embodiment of the present invention, an enhanced water product combined with a safety feature comprises a water bottle containing water and having a neck finish operable with a closure. A closure sealingly fitted to the neck finish has a compartment within to protectively house a solid dosage preparation. A means for selectively and single-handedly dispensing the solid dosage preparation from the compartment, and an integrated means for providing an indication of tampering should pre-purchase access to the compartment be attempted, are provided thereto.

In a particularly preferred embodiment, the means for selectively and single-handedly dispensing comprises a rotatable means for opening the compartment to expose a selected solid dosage preparation. The rotatable means for opening comprises an axis and a roller having opposing sides and a cavity there between. The roller comprises a means for pivoting about the axis. The cavity contains the selected solid dosage preparation. The means for pivoting comprises a pair of coaxial hinge pins protruding from the opposing sides of the roller. The hinge pins are received by a pair of cradles attached to the closure in flanking positions to the compartment wherein the roller is pivotally fixtured.

In another particularly preferred embodiment, the integrated means for providing an indication of tampering comprises a break-away feature frangibly attached to at least one of the hinge pins. The break-away feature has a sufficient extent of structure to bring it into rotational interference with an adjacent structure by any slight rotational movement of the roller. The interference causes the feature to break away. The integrated means for providing an indication of tampering further comprises at least one of the cradles having at least one flexible arm. The flexible arm has a ledge and the corresponding hinge pin has a detent. The ledge and detent are interpositionally disposed when the hinge pin is seated in the cradle. Such interposition prevents the unseating of the hinge pin in any translational direction. At the same time, the combination of the interposition and the flexible arm urges rotation of the roller when an unseating force is applied, the rotation thereof causing a separation of the break-away feature. In this manner, any translational or rotational force, which is to say, any force applied, will cause an indication thereof.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 3:
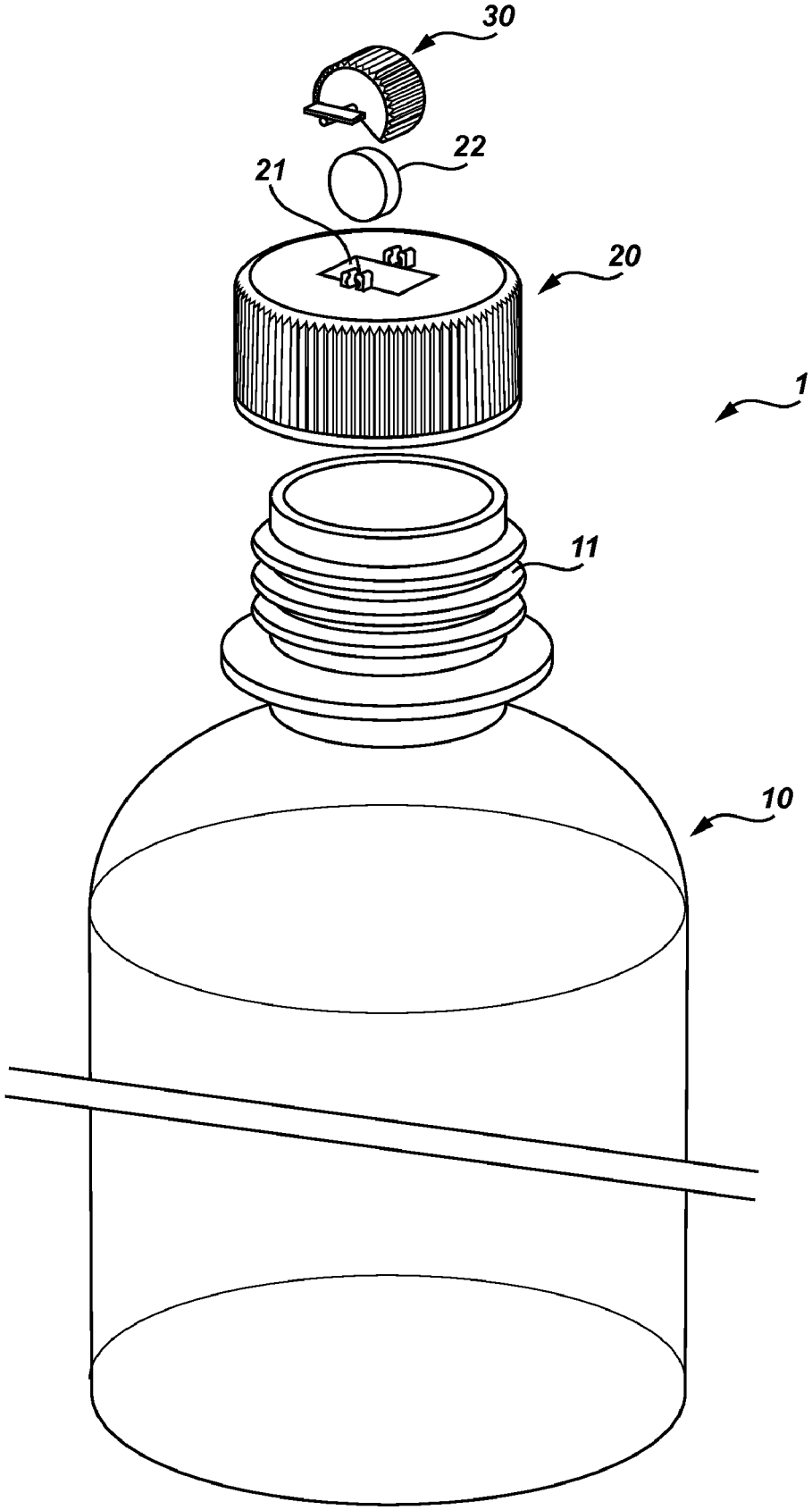
FIG. 3 is an exploded view of the invention in perspective.
Figure 9:
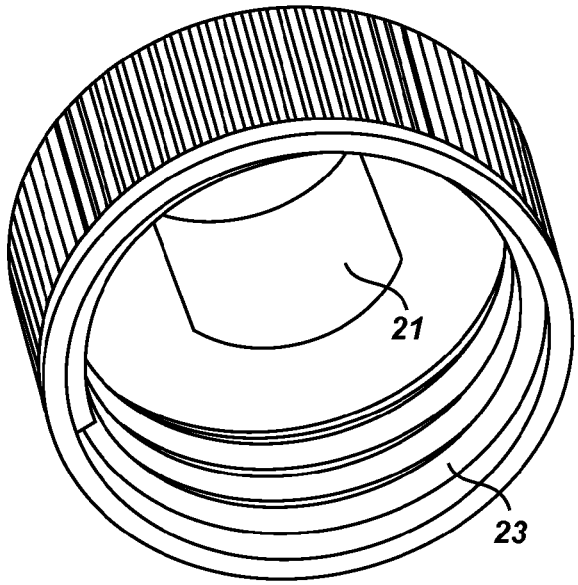
FIG. 9 is a perspective bottom view of the closure.

FIG. 3 best shows the major components of an enhanced water product 1. Water bottle 10 is capped by closure 20. Closure 20 has a means for selectively and single-handedly dispensing 30 a solid dosage preparation 22 housed in a compartment 21 of closure 20. Water bottle 10, containing water, can be sealingly closed by means of screw threads 23 of closure 20 (FIG. 9) and neck finish 11.

Figure 1:
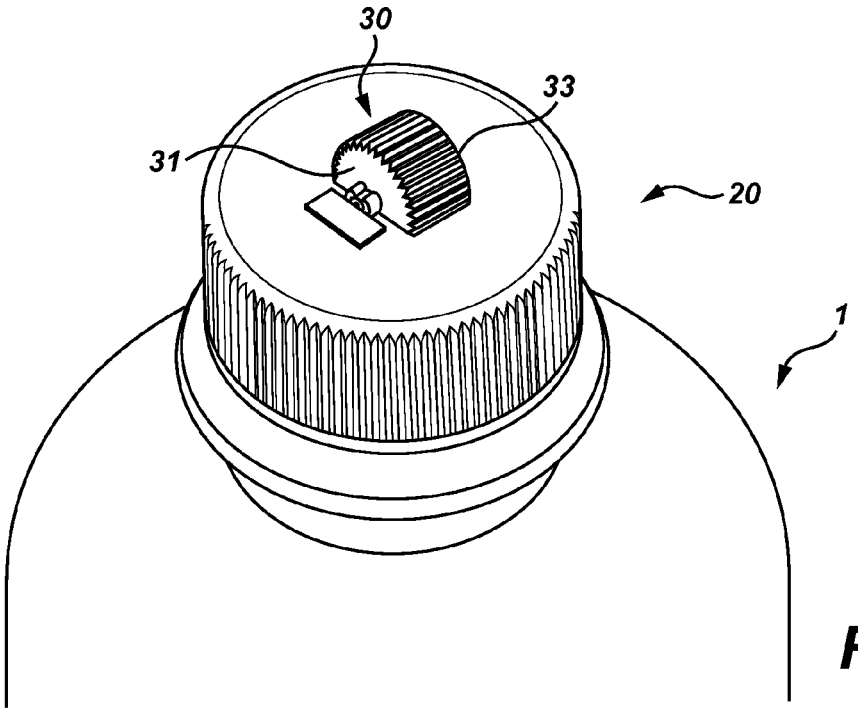
FIG. 1 is a perspective partial view of the closure on the bottle of the invention, illustrating the roller in a closed position and the break-away feature in-tact.
Figure 2:
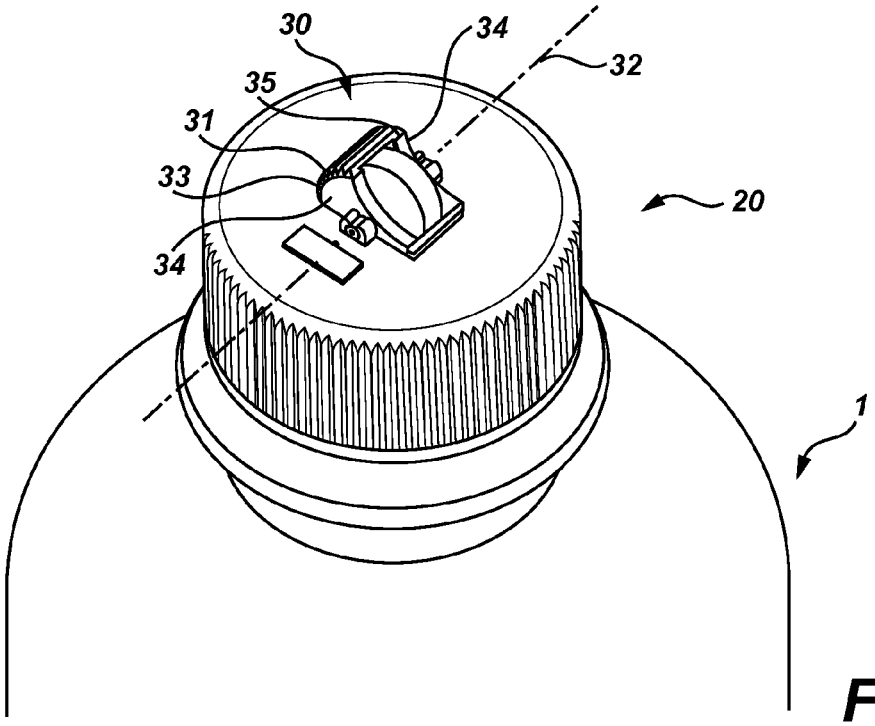
FIG. 2 is a perspective partial view of the closure on the bottle of the invention, illustrating the roller in an open position with the break-away feature separated.

The means for selectively and single-handedly dispensing 30 is best shown in FIGS. 1 and 2. FIG. 1 illustrates a rotatable means for opening 31 in a closed position. FIG. 2 shows the rotatable means for opening 31 in an open position. The rotatable means for opening 31 can be rotated about axis 32 by means of a single finger of a single hand clutching water bottle 10.

Figure 7:
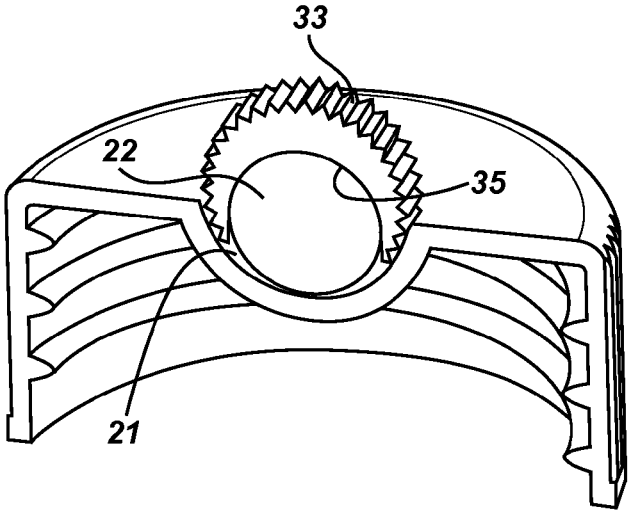
FIG. 7 is a section view of FIG. 6 along the lines 7-7, illustrating the solid dosage form nested in the cavity.

In a preferred embodiment, the rotatable means for opening 31 of the means for selectively and single-handedly dispensing 30 is roller 33. Roller 33 has opposing sides 34 and a cavity 35 there between. Cavity 35 contains solid dosage preparation 22 and dispenses the same when rotated to an open position (see also FIG. 7, showing the nested components). Cavity 35 is scalable, and can be sized to accommodate one, or a plurality, of solid dosage preparations, such as tablets, capsules, caplets, or some volumetric measure of a powder or granulation. The size of cavity 35 is to be determined by the quantity of, or the volume of, the solid dosage preparations constituting a single administration. Compartment 21 may contain one or a plurality of administrations. In the case of a plurality of administrations, it can be seen that roller 33 can selectively dispense an appropriate amount.

Figure 4:
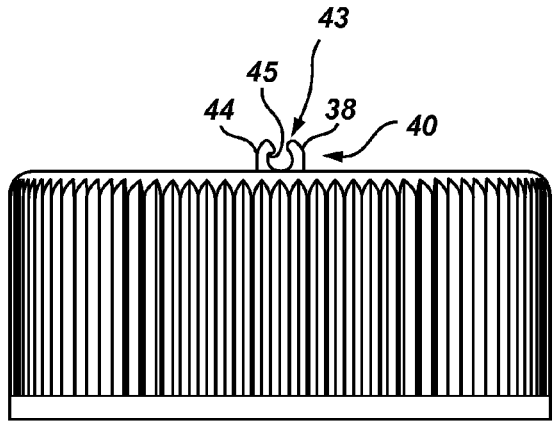
FIG. 4 is an elevation view of the closure without the roller.
Figure 6:
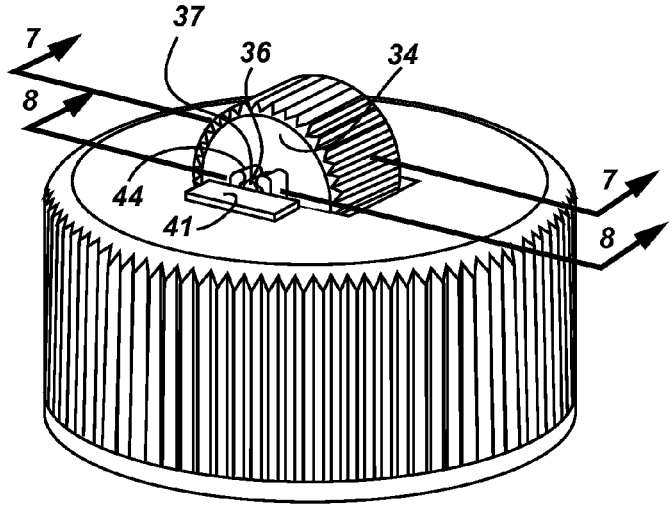
FIG. 6 is a perspective view of the closure with the roller in the closed position.
Figure 8:
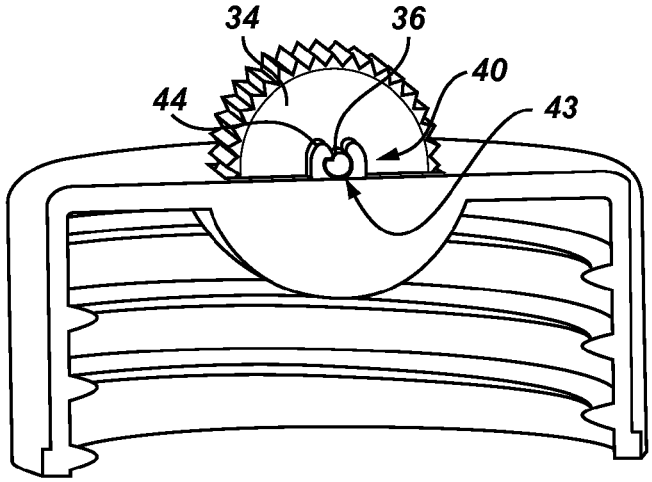
FIG. 8 is another section view of FIG. 6 along the lines 8-8, illustrating the interposition of the ledge and detent features.

Roller 33 has a means for pivoting 36, as best shown in FIGS. 6 and 8. In a preferred embodiment, the means for pivoting 36 comprises hinge pins 37 and cradles 38. Hinge pins 37 are aligned coaxially and protrude from the two opposing sides 34 of roller 33. Hinge pins 37 are received in cradles 38, which flank the compartment 21 such that roller 33 is rotatably suspended in compartment 21. Each cradle 38 has a saddle into which a corresponding hinge pin 37 is seated, the saddle having upright arcuate arms (FIG. 4). At least one of the arms is a flexible arm 44, which permits the hinge pin 37 to bypass over-arching structure and securely seat. In this manner, roller 33 can be assembled to closure 20 by simply pressing against roller 33 to force pins 37 in to cradles 38. This is best done in a closed position with the solid dosage preparation 22 inserted, as the discussion below will make evident.

Figure 5:
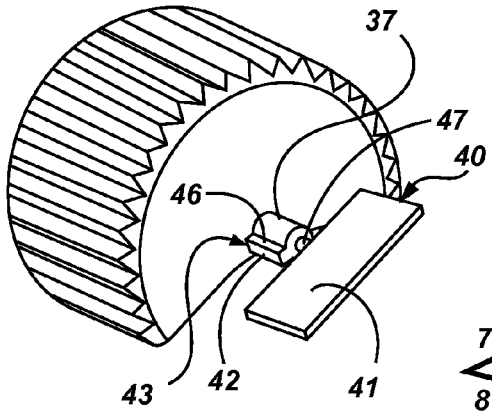
FIG. 5 is a perspective view of the roller and break-away feature.

Enhanced water product 1 further comprises an integrated means for providing indication of tampering 40, as best shown in FIGS. 4 and 5. The means for providing indication of tampering 40 comprises a break-away feature 41 which is frangibly attached to a pivoting member 42. Break-away feature 41 has an extended structure which is in close proximity to the top surface of closure 20. The top surface and the extended structure are substantially parallel when roller 33 is assembled to closure 20 in a closed position. Any attempt to rotate the pivoting member 42 will cause the break-away feature to separate, as shown in FIG. 2. In a preferred embodiment, the pivoting member 42 is at least one of hinge pins 37. Break-away feature 41 is frangibly attached to hinge pin 37 by a filament 47.

The means for providing indication of tampering 40 further comprises a means for inhibiting any non-pivoting movement 43 of roller 33. The means for inhibiting any non-pivoting movement 43 effectively assures that the roller 33 cannot be disassembled, as in reversing the manner in which it was previously assembled, from the closure 20 without indication of the action thereof; in other words, any translational motion resulting in the exposure of the solid dosage preparation 22, in addition to any rotational motion to dispense, must bear witness.

In a preferred embodiment, the means for inhibiting any non-pivoting movement 43 is comprised of a ledge 45 on the flexible arm 44 and a detent 46 on the corresponding hinge pin 37. The ledge 45 and the detent 46 are interpositionally disposed when hinge pin 37 is seated in cradle 38 in the closed position of roller 33. In such a position, and in no other, the break-away feature 41 is substantially hovering above the top surface of closure 20, as best shown in FIG. 6. Once seated, any attempt to move roller 33 in the only translational direction having freedom of movement, that is to say, upwardly, will bring ledge 45 into contact with detent 46 at a radial position offset from axis 32. The moment thereby created by the interposition of ledge 45 and detent 46 will cause a rotational response by roller 33, bringing break-away feature 41 into contact with closure 20 and fracturing filament 47.

The interposition of ledge 45 and detent 46 serves a secondary purpose, as well, by registering the angular position of roller 33. Only one rotational freedom of movement is permitted by the interfering structure, that of the direction tending toward the separation of ledge 45 and detent 46. Rotation in that direction, however, requires flexing flexible arm 44 in order for the hinge pin 37 to bypass ledge 45 with its intrusion into the circumferential path. Flexible arm 44 in the interposition posture thereby biases roller 33 to a discrete closed position.

Water bottle 10 can be formed by known methods in a variety of thermoplastic materials. In the preferred embodiment, the bottle is blow-molded from polyethylene terephthalate (PETE), which is a clear resin of the polyester family. Similarly, production methods and materials for the closure 20 and the roller 33 can be selected from those well known by practitioners in the art. In the preferred embodiment, closure 20 is injection molded from one, or a combination of, polypropylene (PP) or polyethylene (PE), both of which are commodity resins generically known as polyolefin's. It is preferred that roller 33 be injection molded from a resin which lacks the property of toughness, such as non-impact grade polystyrene (PS) or polyethylene (PE). It is also preferred that the bottle 10 come from a stock-supply scenario, where high-volume tooling in continuous production can keep costs to a minimum. It is an advantage of the present invention to allow use of such a non-specialized component for the packaging of water. Solid dosage preparation 22 can be granulated, compressed, or comminuted in accordance with known methods, typically in the domain of pharmaceuticals.

While a particular form of the invention has been illustrated and described, it will be apparent that various modifications can be made without departing from the spirit and scope of the invention. For example: (i) Instead of threading, the closure may snap over a lip on the neck finish; (ii) The compartment may be provided on a separate part which is combinable with the closure to capture the roller there between, thereby eliminating the need for the ledge and detent. Accordingly, it is not intended that the invention be limited, except as by the appended claims.

What is claimed is:

1. An enhanced water product with safety feature, comprising:

a water bottle containing water and having a neck finish operable with a closure;

a closure sealingly fitted to the neck finish having a compartment within;

a solid dosage preparation protectively housed in the compartment;

an axis;

a roller having opposing sides and a cavity there between, the roller further having a pair of coaxial hinge pins protruding from the opposing sides of the roller, the hinge pins being received by a pair of cradles attached to the closure in flanking positions to the compartment wherein the roller is caused to be pivotally fixtured about the axis, the cavity containing the solid dosage preparation; and a break-away feature frangibly attached to at least one of the hinge pins, the break-away feature having a sufficient extent of structure to bring it into fracturing interference with an adjacent structure by any slight rotational movement of the roller;

whereas, the roller comprises a means for selectively and single-handedly dispensing the solid dosage preparation by a rotatable means for opening the compartment to expose a selected solid dosage preparation and the break-away feature comprises an integrated means for providing an indication of tampering should pre-purchase access to the compartment be attempted.

2. The enhanced water product of claim 1, wherein the integrated means for providing an indication of tampering further comprises at least one of the cradles having at least one flexible arm, the flexible arm having a ledge, the corresponding hinge pin having a detent, the ledge and detent being interpositionally disposed when the hinge pin is seated in the cradle, the interposition inhibiting unseating of the hinge pin in a translational direction while the combination of the interposition and the flexible arm urges rotation of the roller when an unseating force is applied, the rotation thereof causing a separation of the break-away feature.

3. An enhanced water product with safety feature, comprising:

a water bottle containing water and having a neck finish operable with a closure;

a closure sealingly fitted to the neck finish having a compartment within;

a solid dosage preparation protectively housed in the compartment;

a roller positioned within the compartment and having an axis and opposing sides with a cavity there between, the cavity containing the selected solid dosage preparation, the roller further having a pair of coaxial hinge pins protruding from the opposing sides of the roller, the hinge pins being received by a pair of cradles attached to the closure in flanking positions to the compartment wherein the roller is caused to be pivotally fixtured; and a break-away feature frangibly attached at least one of the hinge pins, the break-away feature having a sufficient extent of structure to bring it into fracturing interference with an adjacent structure by any slight rotational movement of the roller;

whereas, the roller provides a means for pivoting about the axis to selectively and single-handedly dispense the solid dosage preparation and the break-away feature-becomes separated from the roller in any act of gaining access to the compartment, the separated break-away feature providing an indication of possible tampering.

4. The enhanced water product of claim 3, further comprising at least one of the cradles having at least one flexible arm, the flexible arm having a ledge, the corresponding hinge pin having a detent, the ledge and detent being interpositionally disposed when the hinge pin is seated in the cradle, the interposition inhibiting unseating of the hinge pin in a translational direction while the combination of the interposition and the flexible arm urges rotation of the roller when an unseating force is applied, the rotation thereof causing a separation of the break-away feature.

* * * * *